US006206166B1

(12) United States Patent
Picou

(10) Patent No.: US 6,206,166 B1
(45) Date of Patent: Mar. 27, 2001

(54) COIN-OPERATED MASSAGE TABLE AND METHOD AND SYSTEM FOR PROVIDING HIGH QUALITY MASSAGE

(76) Inventor: Gregory Kevin Picou, 20 Villa Cove, Gulfport, MS (US) 39507

( * ) Notice: Subject to any disclaimer, the term of this patent is extended or adjusted under 35 U.S.C. 154(b) by 0 days.

(21) Appl. No.: 09/310,375

(22) Filed: May 12, 1999

(51) Int. Cl.[7] ..... G07F 11/00
(52) U.S. Cl. ..... 194/241
(58) Field of Search ..... 194/241, 242

(56) References Cited

U.S. PATENT DOCUMENTS 3,683,896 * 8/1972 Peplin ..... 601/16
3,742,941 * 7/1973 Aizenstat ..... 601/49
3,877,422 * 4/1975 Heuser et al. .
3,882,856 * 5/1975 Heuser et al. .
3,948,379 * 4/1976 Warner ..... 194/307
4,190,043 * 2/1980 Thompson .
4,412,534 * 11/1983 Hamabe et al. ..... 601/99
4,586,493 * 5/1986 Goodman .
4,875,470 * 10/1989 Cotone .
5,271,386 * 12/1993 Thompson .

* cited by examiner

*Primary Examiner*—Robert P. Olszewski
*Assistant Examiner*—Bryan Jaketic
(74) *Attorney, Agent, or Firm*—Lowe Hauptman Gopstein Gilman & Berner, LLP

(57) ABSTRACT

A coin-operated massage table features an intersegmented traction table having a plurality of rollers rotating in clockwise and counter-clockwise directions that travel up and down a patient's back. The patient is lying in a supine position on the table during the massaging process. A control panel is used to increase or decrease the height of the rollers which increases or decreases, respectively, the pressure on the back muscles. The control panel is mounted to the table and is connected to a bill acceptor device which accepts coins, bills, tokens, credit cards or debit cards. The massage table operates for a predetermined amount of time based upon the amount of money the patient inserts in the bill acceptor device. Other optional features of the massage table include a vibration device, and hot and cold and moist supplying devices in the table which are controlled by the control panel. These additional devices may be operated following an initial predetermined payment necessary to actuate the table, or may be operable only upon additional predetermined payments.

18 Claims, 4 Drawing Sheets

COIN-OPERATED MASSAGE TABLE AND METHOD AND SYSTEM FOR PROVIDING HIGH QUALITY MASSAGE

TECHNICAL FIELD

The present invention relates generally to massage tables and, more particularly, to coin-operated massage tables.

BACKGROUND ART

Massage therapy is the science concerned with pressure applied to body muscle to stretch and relieve muscle spasms. Skilled massage therapists often use their hands to accomplish this response. Certain treatments, however, are best accomplished slowly or at a certain repeatable frequency that is optimally achieved by machines.

For example, back problems are often caused by disc degeneration. As a result of accidents causing trauma, or improper posture that occurs through long work days of sitting, and lack of exercise, vertebrae discs lose their cushioning abilities and may deteriorate to a position allowing adjacent vertebrae to contact and rub against the nerve. This can be quite painful and, for discs to remain healthy, doctors recommend regular exercise regimens.

In addition to exercise, it has long been recognized that moving a correctly positioned roller longitudinally relative to the spine may retard disc degeneration and may actually repair damaged discs through increased circulation and audible action which is essentially the release of natural buildup of the free floating gases in the body located in the joints. As a consequence, therapy tables relying upon various arrangements of rollers and components inducing vibration are becoming increasingly popular for use in the doctor's office and as retail consumer purchases for home use. This is because such tables can generally operate without close supervision by a doctor.

In view of the above, massage tables are generally available to the public in only one of two ways. The first approach to availability is retail customer purchase for home use. Since these tables can be very expensive, particularly massage tables designed to have actual therapeutic effects, cost prohibitiveness is a factor preventing widespread use. The second approach to use is in a doctor's office. While this avoids the need for the patient to make a large retail purchase, the average cost of use is still high since it is billed at a relatively large dollar amount for a small predetermined time interval (e.g., the average price being about $25.00/10 to 15 minutes of use).

It is accordingly an object of the invention to enhance the availability of massage tables to users without the need for expensive home purchase.

Another object is to increase the use of massage tables without requiring a visit to a doctor's office to either obtain a prescription or to use a massage table.

Still a further object is to make available to users a high quality table at low cost, and to locate these massage tables in needed practical locations where people yearn for such devices.

Yet a further object is to make such tables available in which the table design is based on the specifications dictated by the doctor.

SUMMARY OF THE INVENTION

The present invention concerns a coin and currency operated massage table comprising a table having a supporting surface on which a user is adapted to lie in a supine position. It is within the scope of this invention to substitute a massage chair instead of a table and the terms "table" and "chair" should be considered as interchangeable within the context of this specification. At least one body acting member is movably mounted to the table to project from the supporting surface to interact with the user's body when lying against said surface. A motive system is operatively mounted to the table to move the body acting member relative to the table. In accordance with the invention, a payment device is connected to the motive system and adapted to be connected to a power source to accept one of coin and currency and thereupon actuate the motive system for a predetermined time interval so that the user receives a massage.

The foregoing coin operated massage table advantageously provides users with an opportunity to receive a high quality massage without having to either purchase a motorized massage table or chair through retail sale, or experience massage only by means of an expensive visit to a doctor's office or similar prescriptive event. It is contemplated that the same benefits of massage as available through a doctor's or physical therapist's office can now be made available to users through the advent of a coin and currency operated, publicly placed massage table in accordance with the objects of the present invention.

Preferably, the motive system includes a motor controller and a drive motor connected to the body acting member and the payment device includes a currency validator and a PLC timer connecting the currency validator to the motor controller. The currency validator includes a circuit converting an amount of currency received into a representative series of pulse outputs which are communicated to the PLC timer which then converts the pulse outputs into timed increments that actuates and then shuts the motor controller. Optionally, the validator is incapable of at least one of making change and returning said currency.

In accordance with a further feature of the invention, there is further included a data accumulator operatively connected to the PLC timer to store data representative of how much currency has been deposited into the currency validator. In this manner, the owner of the coin operated table may plan removal of currency when a sufficient amount of money has been accumulated through the currency validator and before an associated currency stacker becomes full which would render the table inoperative.

In the preferred embodiment, the table is an intersegmented traction table which has a plurality of rollers positioned with their axes horizontal. The rollers are carried by a roller transport mechanism that functions to move the rollers along a user's back muscles. The intersegmented traction table may further include a support device which positions the supine user in alignment with the roller. The height of the rollers is adjustable relative to a user's back by a roller height regulation device that functions to adjust the vertical position of the roller relative to the user's back. The intersegmented traction table may further have a control panel functioning to permit the user to regulate the speed and direction of advance of the rollers and the height of the rollers. The intersegmented traction table is connected to a power source that typically is electrical and is attached to the payment device which accepts both coin and currency.

The payment device may also be a card reader used in substitution for, or in conjunction with, the coin and currency validator. The payment device functions to regulate the time the user can receive a massage.

The present invention is also directed to a massage system in which a plurality of tables as described hereinabove are located in geographically disparate areas such as throughout a city or other geographic locale. In one preferred embodiment, these areas are publicly accessible to encourage users to experience the benefits of massage at a relatively low cost. However, it is also within the scope of this invention to position one or more of the tables in a doctor's office and/or a physical therapist's office. In the latter type of use, i.e., in a professional office, it is preferred that the massage table have the capability of disablement of the payment device so that the table may be optionally used in a conventional manner without coin operation.

A method of offering massage in accordance with the invention is also disclosed. The method comprises the steps of providing a user with a coin or credit card operated, motor controlled massage unit at a predetermined location, and enabling the user to receive a massage by lying on the massage unit after depositing a predetermined amount of money into a currency/card validator physically mounted proximate the unit.

The unit is preferably located only at a publicly accessible location. However, it is within the scope of this invention to locate at least one unit in a doctor's office.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
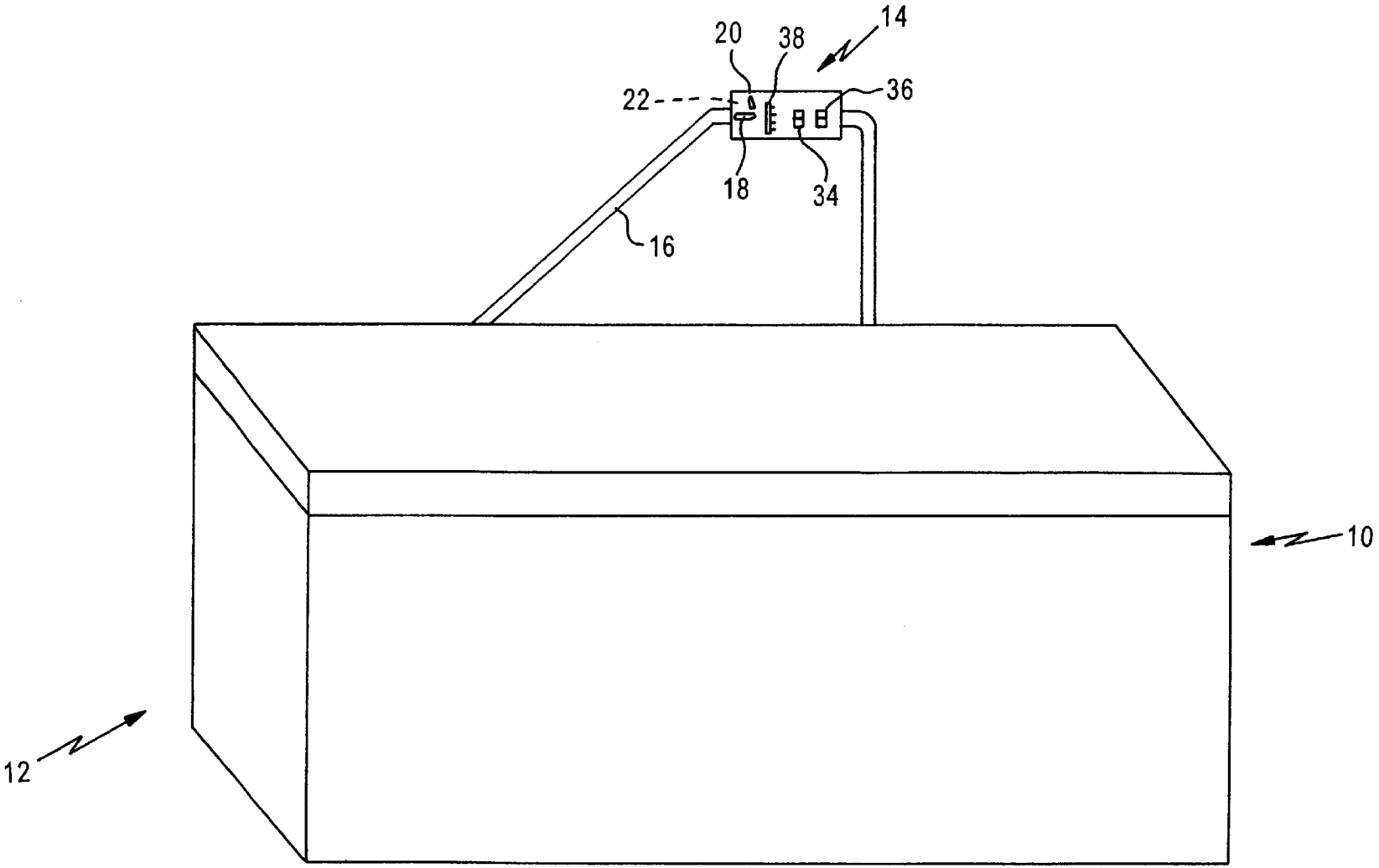
FIG. 1 is a perspective view of a coin operated massage table in accordance with the present invention.

FIG. 1 is an illustration of coin and currency operated massage table 10 of the invention which is comprised of a table 12 that may be of conventional design having a full feature control panel 14 mounted to the table 12 with an assist bar 16. In accordance with the unique features discussed more fully below, control panel 14 includes a paper currency receipt slot 18 and an optional coin slot 20 adapted to respectively receive either paper currency (in various denominations such as $1, $5, $10 and $20 bills) and coins. These payment receipt slot mechanisms 18,20 form a part of a currency validator unit 22 disposed within control panel 14. Once currency validator unit 22 receives coin or currency and verifies the authenticity thereof, the validator communicates pulse outputs through a serial connector 24 to a PLC timer and data accumulator 30 that may also be disposed within the control panel. This now enables actuation of the massage table 12 for a programmed period of time corresponding to the amount of payment and enables the user to control the extent of roller travel and height and/or rotation through manipulation of switches 34 and 36 while monitoring roller height by observation of roller height indicator bar 38.

The massage table 12, as mentioned above, may be of standard construction such as a VERTEFLEX™, manufactured by KMK Inc., Colorado Springs, Colorado, that is modified to incorporate currency validator and stacker unit 22, PLC timer and data accumulator 30, serial connections 20,40 all interconnected through connection 70 to the motor controllers (not shown in detail) forming a part of the conventional machine. Massage table 12 thereby preferably includes an elevating roller frame with an extension spring to better enable the machine to adapt to the contour of the spine. This type of machine may further incorporate a smooth operating traverse rod and block assembly that requires no maintenance, grease or oil and also voids mess, backlash or risk of damaged machine that may otherwise occur in less expensive machines where rollers can slip, bind and need frequent service. These machines may also feature durable, poured polyurethane rollers which are permanently attached to fixed steel trunnion pins to avoid vibration, rattles or replacement of the trunnion assembly or rollers for the life of the machine.

Such known machines described in sufficient detail above are generally unavailable for retail purchase and tend to be used in doctors' offices where patients are charged relatively high fees for incremental amounts of massage time.

However, in accordance with the present invention, the incorporation of a coin or currency operated payment device connected to the motive system of the conventional massage table advantageously allows for placement of such tables in publicly accessible areas (e.g., bus terminals, airport waiting lounges, exercise gyms, truck stops, etc.) where user's can now enjoy massage with sophisticated equipment on a "pay as you go" basis, without the need to visit a doctor's office, or otherwise obtain a prescription for visitation to a physical therapist's office.

The currency validator unit 22 may be of conventional construction (e.g., Model DBV 45/145 SU manufactured by JCM) to receive paper currency of different denominations (e.g., $1, $5, $10 and $20) that will dictate the amount of time the machine is actuated. Upon placement of currency in slot 18, the authenticity of the bills is verified by the currency validator. Once verified, the validator 22 communicates pulse outputs through a serial connector 20 to a PLC timer and data accumulator 30, also of known construction (such as Model MICRO$^3$, manufactured by IDEC) which signals to the PLC timer how much money has been deposited into the validator. This enables the PLC timer 30 (which essentially functions as a miniature processing unit) to convert the pulse from the currency validator 22 into timed increments (e.g., two minutes per pulse). The validator then essentially counts currency and outputs pulses to the timer 30 which is connected to one or more motor controllers 50 through a connector 70 that enables the motor controllers to actuate the drive motors 75 for a predetermined amount of time in which the table provides massage.

Once this function has taken place and the PLC timer 30 has accumulated the pulses, it preferably has the capability of storing the data (i.e., how much currency has been deposited either individually per use and/or cumulatively) into the validator 22. Periodically, in accordance with the preferred embodiment, a connection 40 between a conventional dial in communicator 80 and the PLC timer/data accumulator 30 enables remote polling from a remotely located computer 82 through a phone line 84 to determine how much currency has been accumulated as a result of use. In this manner, the remote location containing the massage table 10 can be visited only when a sufficient amount of currency has been accumulated in order to prevent the currency stacker 22 from becoming full and therefore inoperative.

It is also within the scope of this invention to replace, or supplement, the currency validator and stacker unit 22 with a credit card reader of conventional construction which will enable the user to obtain massage by appropriate swiping of their credit card in the reader.

Figure 2:
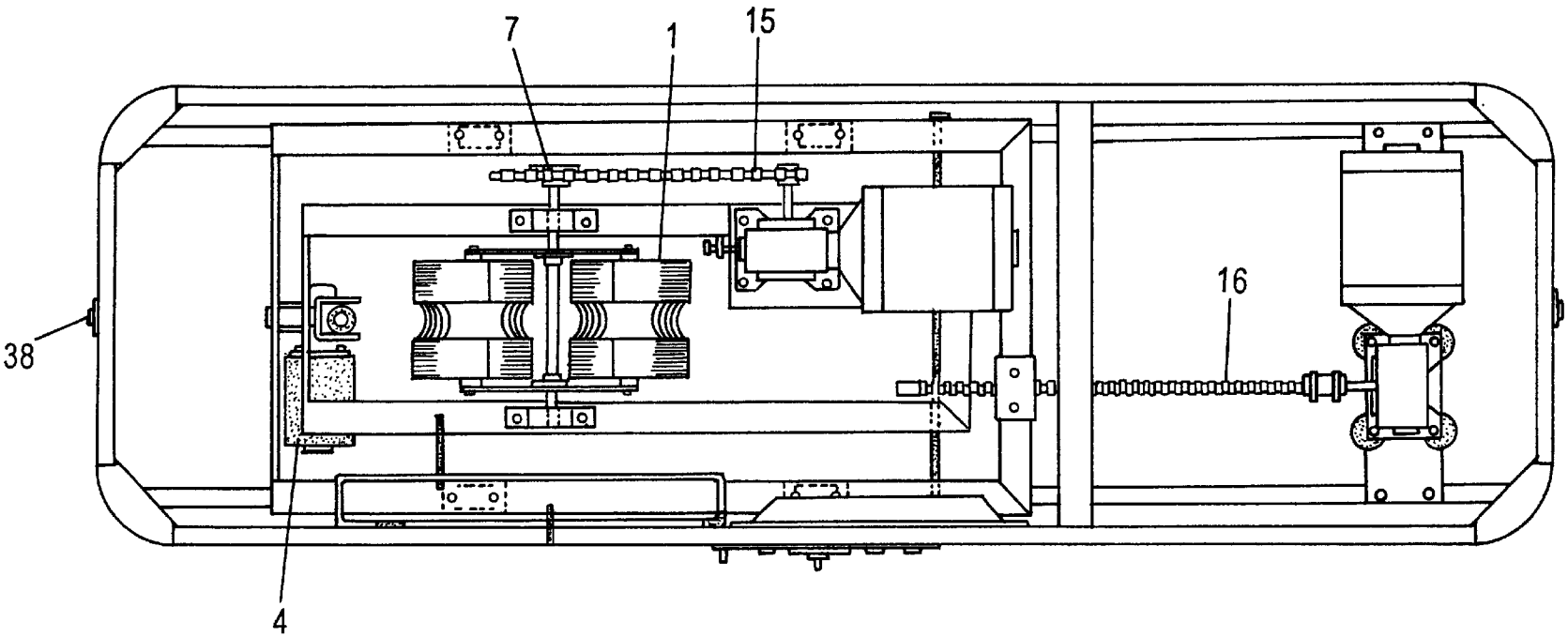
Fig. 2 (PRIOR ART)
FIG. 2 is a top plan view, partly in schematic, of the mechanical components in the massage table of FIG. 1.
Figure 4:
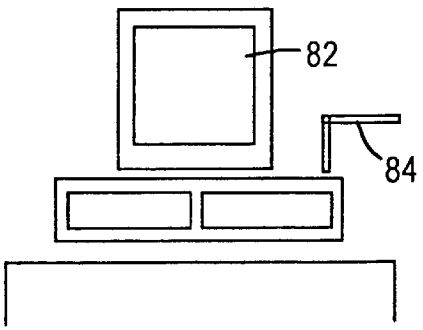
FIG. 4 is a schematic illustration of a remote computer for use with the preferred embodiment of the invention.
Figure 3:
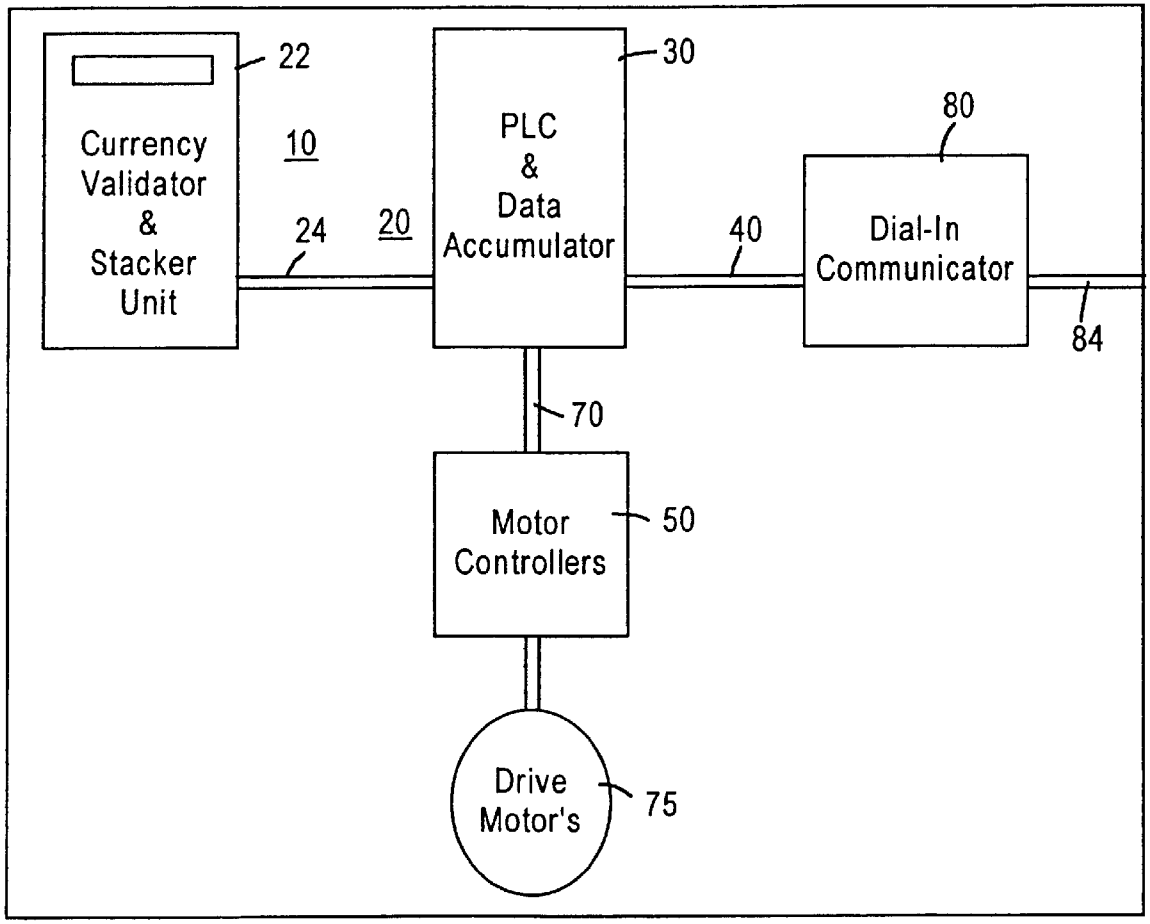
FIG. 3 is a schematic illustration of the payment device and its interconnection with the mechanical components of the massage table.

Another type of high quality massage table of known construction is depicted in FIG. 2 and is known as the Spinalator, available from the Spinalator Company of Asheville, N.C. The Spinalator model generally features a number of rollers 1 that are capable of moving along the length of the table as a result of a chain and sprocket arrangement 7,15 to project into the surface of the exercise table upon which the supine user lies in order to receive massage benefit. The height of rollers 1 may be adjusted with a roller elevator motor 4. The roller arrangement is further translated by means of a traverse screw drive gear 16 to provide full body coverage.

In addition to the Spinalator, another massage table known as Aqua PT made by AMI of Connecticut, Mass. The Aqua PT utilizes 36 water jets to force heated water onto the back muscles of the prone user. Hand-held control is used to regulate direction speed and force of water massage table.

Figure 5:
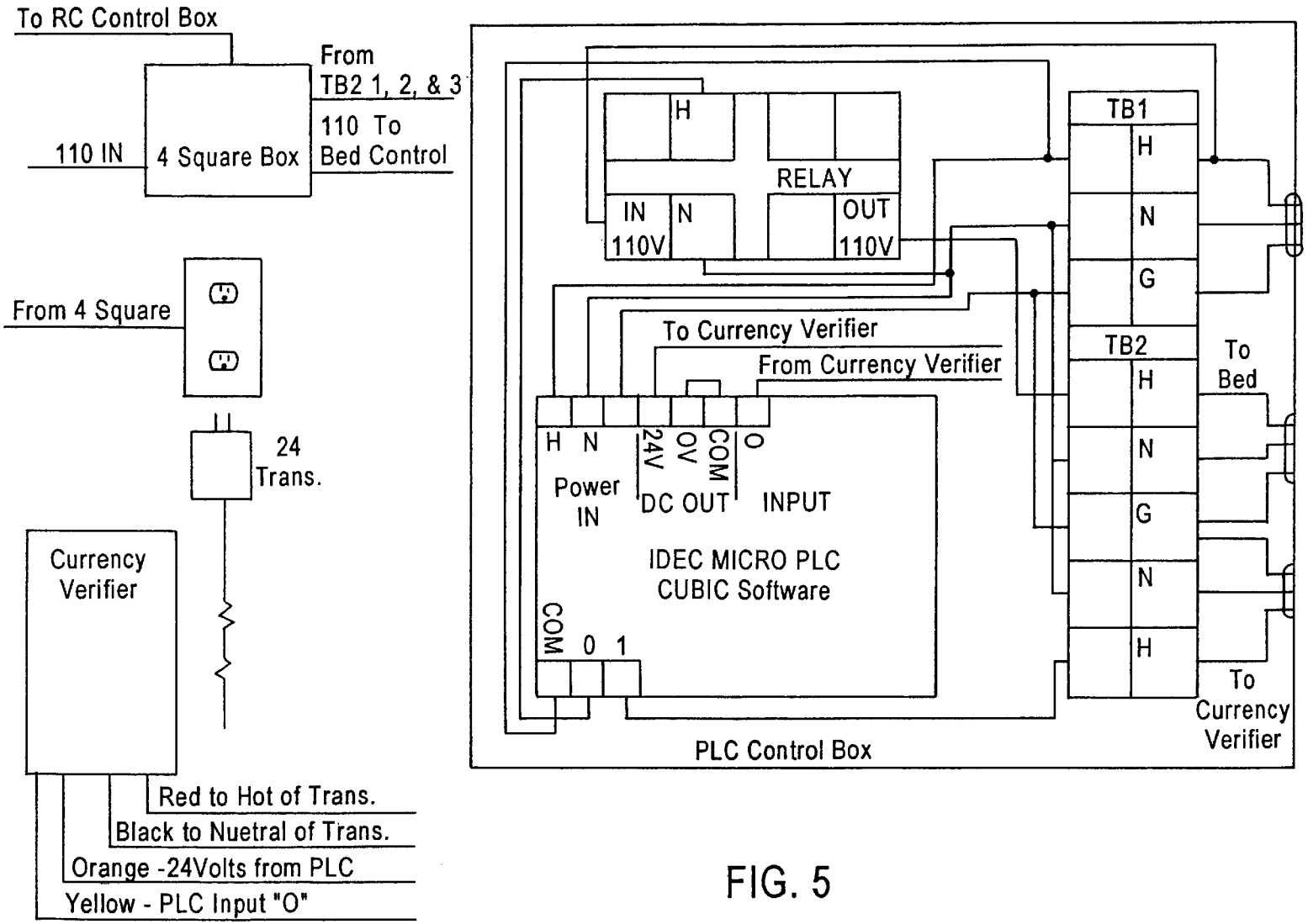
FIG. 5 is a schematic view illustration of the electrical connections between the currency verifier and PLC control box together with the operative mechanical components.

FIG. 5 is a schematic view illustration of the electrical connections between the currency verifier and PLC control box together with the operative mechanical components. The manner in which the electrical connections are to be made in the preferred embodiment will be apparent to persons skilled in the art upon review of FIG. 5 when taken in conjunction with the other drawings figures.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A coin and/or currency operated massage table, comprising:

(a) a massage table having a supporting surface on which is user is adapted to lie in a supine position;

(b) at least one body acting member movably mounted to the table to project from the supporting surface to interact with the user's body when lying against said surface;

(c) a motive system operatively mounted to the table to move the body acting member relative to the table; and (d) a payment device connected to the motive system and adapted to be connected to a power source to accept one of coin and currency and thereupon actuate the motive system for a predetermined time interval so that the user receives a massage;

wherein said motive system includes at least one motor controller and at least one drive motor connected to said body acting member and said payment device includes a currency validator and a PLC timer connecting said currency validator to said motor controller.

2. The massage table of claim 1, wherein said currency validator includes a circuit converting an amount currency received into a representative series of pulse outputs which are communicated to the PLC timer which converts said pulse outputs into timed increments that actuates and then shuts said at least one motor controller.

3. The massage table of claim 1, further comprising a data accumulator operatively connected to the PLC timer to store data representative of how much currency has been deposited into the currency validator.

4. The massage table of claim 1, wherein said validator is incapable of at least one of making change and returning said currency.

5. The massage table of claim 1, wherein said table is an intersegmented traction table having a plurality of rollers functioning as said at least one body acting member; a roller transport means for moving the rollers along a user's back; a support device which positions the prone user in alignment with the rollers; a roller height regulation device functioning to adjust the elevation of the roller relative to the user's back; and a control device functioning to permit the user to regulate the speed of advance of the rollers and the height of the rollers.

6. The massage table of claim 1, further comprising a credit card reader connected to the motive system to accept payment by means of magnetically encoded credit cards.

7. A massage system, comprising:

(a) a plurality of coin and currency operated massage tables located in publicly accessible, separate geographic areas to enable one or more users to gain access to massages, each said massage table comprising:

(i) a table having a supporting surface on which is user is adapted to lie in a supine position;

(ii) at least one body acting member movably mounted to the table to project from the supporting surface to interact with the user's body when lying against said surface;

(iii) a motive system operatively mounted to the table to move the body acting member relative to the table; and (iv) a payment device connected to the motive system and adapted to be connected to a power source to accept one of coin and currency and thereupon actuate the motive system for a predetermined time interval so that the user receives a massage;

wherein said motive system includes at least one motor controller and at least one drive motor connected to said body acting member and said payment device includes a currency validator and a PLC timer connecting said currency validator to said motor controller.

8. The massage system of claim 7, wherein additional ones of said tables are installed in offices of licensed doctors.

9. The massage system of claim 7, wherein said currency validator includes a circuit converting an amount currency received into a representative series of pulse outputs which are communicated to the PLC timer which converts said pulse outputs into timed increments that actuates and then shuts said motor controller(s).

10. The massage system of claim 7, further comprising a data accumulator operatively connected to the PLC timer to store data representative of how much currency has been deposited into the currency validator.

11. The massage system of claim 7, wherein said table is an intersegmented traction table having a plurality of rollers functioning as said at least one body acting member; a roller transport means for moving the rollers along a user's back; a support device which positions the supine user in alignment with the rollers; a roller height regulation device functioning to adjust the elevation of the roller relative to the user's back; and a control device functioning to permit the user to regulate the speed of advance of the rollers and the height of the rollers, the direction of rotation, amount of heat and/or vibration.

12. The massage system of claim 7, wherein said publicly accessible areas include at least one of bus stations, airports, public office buildings, government office buildings, and massage parlors.

13. The massage system of claim 7, further comprising a credit card reader connected to the motive system to accept payment by means of magnetically encoded credit cards.

14. A massage system, comprising:

(a) a plurality of coin and currency operated massage tables located in publicly accessible, separate geographic locations to enable one or more users to gain access to massages, each said massage table comprising:

(i) a table having a supporting surface on which is user is adapted to lie in a supine position;

(ii) at least one body acting member movably mounted to the table to project from the supporting surface to interact with the user's body when lying against said surface;

(iii) a motive system operatively mounted to the table to move the body acting member relative to the table; and (iv) a payment device connected to the motive system and adapted to be connected to a power source to accept one of coin and currency and thereupon actuate the motive system for a predetermined time interval so that the user receives a massage;

further comprising a central computer and a modem for enabling said central computer to dial up and poll each said location to determine the amount of currency being held in the respective currency validators.

15. A method of offering massage, comprising the steps of:

(a) providing a user with a coin or credit card operated, motor operated massage unit at a predetermined location; and (b) enabling the user to receive a massage by lying on the unit after depositing a predetermined amount of money into a currency/card validator physically mounted proximate the unit;

comprising the further step of remotely monitoring the frequency of use of said unit by periodically polling the unit with a modem connection.

16. The method of claim 15, wherein said unit is located only at a publicly accessible geographic location.

17. The method of claim 15, wherein said unit is located in at least one of a publicly accessible geographic location and a doctor's office.

18. A legal tender operated massage unit, comprising:

(a) a massage unit having a supporting surface on which is user is adapted to lie in a predetermined position;

(b) at least one body acting member movably mounted to the unit to project from the supporting surface to interact with the user's body when lying against said surface;

(c) a motive system operatively mounted to the unit to move the body acting member relative to the unit; and (d) a payment device connected to the motive system and adapted to be connected to a power source to accept legal tender and thereupon actuate the motive system for a predetermined time interval so that the user receives a massage;

wherein said motive system includes at least one motor controller and at least one drive motor connected to said body acting member and said payment device includes a timer interface between a legal tender validator and the motor controller.

* * * * *